US011614241B2

(12) United States Patent
Lee et al.

(10) Patent No.: US 11,614,241 B2
(45) Date of Patent: Mar. 28, 2023

(54) DEHUMIDIFIER

(71) Applicant: Samsung Electronics Co., Ltd, Gyeonggi-do (KR)

(72) Inventors: Dong-yoon Lee, Suwon-si (KR); Yong-hun Kang, Seoul (KR); Keun-jeong Jang, Yongin-si (KR); Kyoung-jong Yun, Hwaseong-si (KR); Ha-young Yoon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 283 days.

(21) Appl. No.: 15/773,137

(22) PCT Filed: Oct. 31, 2016

(86) PCT No.: PCT/KR2016/012414
§ 371 (c)(1),
(2) Date: May 2, 2018

(87) PCT Pub. No.: WO2017/078354
PCT Pub. Date: May 11, 2017

(65) Prior Publication Data

US 2018/0320910 A1 Nov. 8, 2018

(30) Foreign Application Priority Data

Nov. 2, 2015 (KR) ..... 10-2015-0153032

(51) Int. Cl.
*F24F 13/08* (2006.01)
*F24F 1/0358* (2019.01)
(Continued)

(52) U.S. Cl.
CPC ..... *F24F 1/0358* (2019.02); *F24F 13/02* (2013.01); *F24F 13/08* (2013.01); *F24F 13/15* (2013.01);
(Continued)

(58) Field of Classification Search
CPC .. F24F 13/15; F24F 13/20; F24F 13/02; F24F 13/08; F24F 3/1405; F24F 7/08; F24F 2013/088; F24F 2003/1446
See application file for complete search history.

(56) References Cited

FOREIGN PATENT DOCUMENTS

CN 103574873 A * 2/2014
CN 103574873 A 2/2014
(Continued)

OTHER PUBLICATIONS

English Translation of CN-104791917-A (Year: 2019).*
(Continued)

*Primary Examiner* — Jonathan Bradford

(57) ABSTRACT

Disclosed is a dehumidifier capable of dehumidifying an indoor space more efficiently. The present dehumidifier comprises: a body having an intake opening and a discharge opening; a blowing fan arranged inside the body so as to draw air into the body through the intake opening and to discharge the same to the outside through the discharge opening; a fan case having a duct arranged inside the body so as to provide a channel through which the air drawn by the blowing fan flows to the discharge opening; a heat exchanger arranged inside the body so as to remove moisture from the air that has flown into the body; and fixed blades that are fixedly installed inside the duct so as to split the air, which has flowed through the channel, to a plurality of discharge paths.

15 Claims, 10 Drawing Sheets

(51) Int. Cl.

| | |
|---|---|
| ***F24F 13/15*** | (2006.01) |
| ***F24F 13/02*** | (2006.01) |
| ***F24F 13/20*** | (2006.01) |
| *F24F 3/14* | (2006.01) |

(52) U.S. Cl.
CPC ..... *F24F 13/20* (2013.01); *F24F 2003/1446* (2013.01); *F24F 2013/088* (2013.01)

(56) References Cited

FOREIGN PATENT DOCUMENTS

| | | | | |
|---|---|---|---|---|
| CN | 104748340 | A | | 7/2015 |
| CN | 104791917 | A | * | 7/2015 |
| CN | 104791917 | A | | 7/2015 |
| EP | 2123494 | A1 | | 11/2009 |
| EP | 2918938 | A1 | | 9/2015 |
| EP | 2821717 | B1 | | 8/2017 |
| JP | 2008025881 | A | * | 2/2008 |
| JP | 2009-192137 | A | | 8/2009 |
| JP | 2009192137 | A | * | 8/2009 |
| JP | 2009-299991 | A | | 12/2009 |
| JP | 2012-159234 | A | | 8/2012 |
| JP | 5471250 | B2 | | 4/2014 |
| JP | 2015137796 | A | | 7/2015 |
| KR | 10-0409003 | B1 | | 12/2003 |
| KR | 10-0765163 | B1 | | 10/2007 |
| KR | 10-1226268 | B1 | | 1/2013 |
| KR | 10-2014-0133973 | A | | 11/2014 |
| KR | 10-1461849 | B1 | | 11/2014 |
| KR | 20140133973 | A | * | 11/2014 |
| KR | 10-2015-0001063 | A | | 1/2015 |
| KR | 10-2015-0004991 | A | | 1/2015 |
| KR | 10-2015-0051015 | A | | 5/2015 |
| KR | 10-2015-0057002 | A | | 5/2015 |
| KR | 10-2015-0077693 | A | | 7/2015 |
| KR | 10-2015-0078558 | A | | 7/2015 |
| WO | 2008010384 | A1 | | 1/2008 |
| WO | 2015141023 | A1 | | 9/2015 |

OTHER PUBLICATIONS

English Translation of JP-2008025881-A (Year: 2019).*
English Translation of JP-2009192137-A (Year: 2020).*
English Translation of CN-103574873-A (Year: 2020).*
English Translation of KR-20140133973-A (Year: 2019).*
European Patent Office, "Supplementary European Search Report," Application No. EP 16862370.0, dated Sep. 10, 2018, 8 pages.
International Search Report dated Jan. 6, 2017 in connection with International Patent Application No. PCT/KR2016/012414.
Written Opinion of the International Searching Authority dated Jan. 6, 2017 in connection with International Patent Application No. PCT/KR2016/012414.
National Intellectual Property Administration, PRC, "The First Office Action," Application No. CN201680063925.8, dated Oct. 9, 2019, 20 pages.
Office Action dated Mar. 12, 2020 in connection with Chinese Patent Application No. 201680063925.8, 19 pages.
Korean Intellectual Property Office, "Notice of Preliminary Rejection" dated Jan. 20, 2022, in connection with Korean Patent Application No. 10-2015-0153032, 14 pages.
Notice of Decision of Rejection dated Jul. 29, 2022 in connection with Korean Patent Application No. 10-2015-0153032, 7 pages.
Notice of Allowance dated Nov. 21, 2022 in connection with Korean Patent Application No. 10-2015-0153032, 8 pages.

* cited by examiner

DEHUMIDIFIER

CROSS-REFERENCE TO RELATED APPLICATIONS AND CLAIM OF PRIORITY

This application is a 371 of International Application No. PCT/KR2016/012414 filed Oct. 31, 2016, which claims priority to Korean Patent Application No. 10-2015-0153032 filed Nov. 2, 2015, the disclosures of which are herein incorporated by reference into their entirety.

TECHNICAL FIELD

Apparatuses and methods consistent with the present invention relate to a dehumidifier, and more particularly to, a dehumidifier capable of dehumidifying an indoor space more efficiently by controlling a flow of dehumidified air.

BACKGROUND

In general, a dehumidifier is used to lower humidity of an indoor space. The dehumidifier includes refrigerating cycle elements that are arranged inside a body forming an external appearance. The refrigerating cycle elements include a compressor, a condenser, an expansion valve, an evaporator, and a blowing fan.

The blowing fan provides a suction force and a blowing force by rotating so as to enable air of the indoor space to pass through the body. If the air of the indoor space is forced to pass through the evaporator of the body, moisture included in the air is condensed on a surface of the evaporator, and thus dehumidifying is achieved.

However, as the blowing fan is provided as a blower type, discharged air is off-center along a rotation direction of the blowing fan. In other words, there are problems like a discharged current of air may not be controlled toward a direction desired by a consumer, indoor dehumidifying efficiency is lowered, and the like.

SUMMARY

The present invention provides a dehumidifier capable of achieving dehumidifying efficiently through an air current control.

The present invention also provides a dehumidifier capable of changing an air current, which is off-center by a fan, to a straight air current.

According to an aspect of the present invention, a dehumidifier includes a body having an intake opening and a discharge opening, a blowing fan arranged inside the body so as to draw air into the body through the intake opening and to discharge the air to an outside through the discharge opening, a fan case having a duct arranged inside the body so as to provide a channel through which the air drawn by the blowing fan flows to the discharge opening, a heat exchanger arranged inside the body so as to remove moisture from the air that flows into the body, and fixed blades that are fixedly installed inside the duct so as to split the air, which flows through the channel, to a plurality of discharge paths.

The fixed blades may be arranged across a width direction of the discharge opening.

The fixed blades may have preset heights toward the discharge opening and are arranged to be parallel with one another.

The discharge opening may be provided in an upper part of the body, and upper ends and lower ends of the fixed blades may be arranged to be off-center to one another.

The duct may have a shape of which a cross-sectional area increases upwards and have a first slope part having a shape sloping upwards to the discharge opening and a second slope part arranged opposite to the first slope part so as to have a gentler slope than the first slope part, and the fixed blades may respectively have front fixed sides arranged opposite to the first slope part so as to have first curvatures that are convex toward the first slope part and rear fixed sides arranged opposite to the second slope part so as to have second curvatures that are concave toward the second slope part.

The first curvatures may be larger than the second curvatures.

The dehumidifier may further include a dispersion plate that is arranged on sides of the fixed blades to be installed inside the duct and has a plurality of dispersion holes through which air flowing through the fixed blades is dispersed.

The dispersion holes may be hexagonal shapes, and the dispersion plate may be a honeycomb structure.

The fixed blades and the dispersion plate may be provided as an all-in-one structure with the fan case.

The dehumidifier may further include rotating blades that are arranged on sides of the fixed blades so as to change a discharge direction of air that flows through the fixed blades.

The discharge opening may be formed in an upper side of the body, and the rotating blades may be arranged across the width direction of the discharge opening.

A plurality of rotating blades may be provided, and the rotating blades may have preset heights along upward and downward directions and may be arranged so as to be parallel with one another.

The duct may have a communication opening that is connected to the discharge opening, and upper ends of the rotating blades may project above the communication opening.

The fixed blades may be arranged at preset distances along a longitudinal direction of the discharge opening and may have the preset heights along the upward and downward directions, and the number of rotating blades may be equal to or smaller than the number of fixed blades.

The dehumidifier may further include rotation axes that are respectively axially combined with the rotating blades so as to be rotatably supported by the duct, a driving member that is connected to at least one of the rotation axes so as to rotate and drive the rotation axis, and a link member that is arranged under the rotation axes and connected to the rotating blades.

The rotating blades may be arranged under the rotation axes and may have projections projecting from the rotating blades, and the link member may be arranged so as to be perpendicular to the rotating blades and may have fixing holes into which the projections are inserted so as to be rotatably supported.

The rotating blades may rotate in one direction by a driving force of the driving member so as to rotate in an opposite direction to a first position where the upper ends of the rotating blades are off-center to sides of the lower ends in order to change to a second position where the upper ends of the rotating blades are off-center to other sides of the lower ends.

According to another aspect of the present invention, a dehumidifier includes a body having an intake opening and a discharge opening, a blowing fan arranged inside the body so as to draw air into the body through the intake opening and to discharge the air to an outside through the discharge opening, a fan case having a duct arranged inside the body so as to provide a channel through which the air drawn by the blowing fan flows to the discharge opening, a heat exchanger arranged inside the body so as to remove moisture from the air that flows into the body, fixed blades that are fixedly installed inside the duct so as to split the air, which flows through the channel, to a plurality of discharge paths, rotating blades arranged above the fixed blades so as to change a discharge direction of air that flows through the fixed blades, and a dispersion plate arranged between the fixed blades and the rotating blades and having a plurality of dispersion holes through which the air split by the fixed blades is dispersed.

The fixed blades may be arranged across a width direction of the discharge opening and may have preset heights toward the discharge opening.

The dehumidifier may further include rotation axes that are respectively axially combined with the rotating blades so as to be rotatably supported by the duct, a driving member that is connected to at least one of the rotation axes so as to rotate and drive the rotation axis, and a link member that is arranged under the rotation axes and connected to the rotating blades.

DETAILED DESCRIPTION

Figure 1:
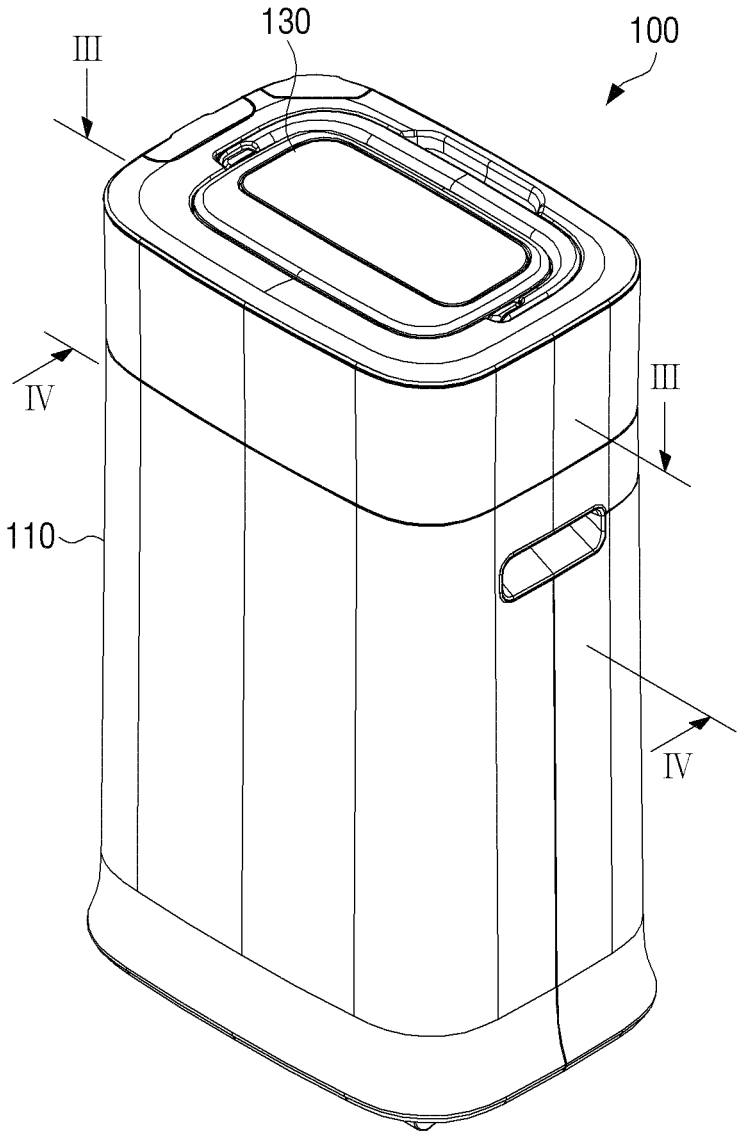
FIG. 1 is a perspective view illustrating a front side of a dehumidifier according to an exemplary embodiment of the present invention.

Hereinafter, exemplary embodiments of the present invention will be described in more detail with reference to FIGS. 1 through 10. Exemplary embodiments that will be described hereinafter will be based on exemplary embodiments that are most appropriate to understand technical characteristics of the present invention. The technical characteristics of the present invention are not limited by the exemplary embodiments that will be described, but the present invention may be embodied like the exemplary embodiments that will be described hereinafter.

Therefore, the present invention may be made into various modifications within the scope of the present invention through the exemplary embodiments that will be described hereinafter, and these modified exemplary embodiments will belong to the scope of the present invention. Also, as to reference numerals illustrated in the attached drawings to assist understanding of the exemplary embodiments that will be described hereinafter, related elements of elements operating the same function in respective exemplary embodiments are denoted by the same numbers or numbers on extension lines.

Figure 2:
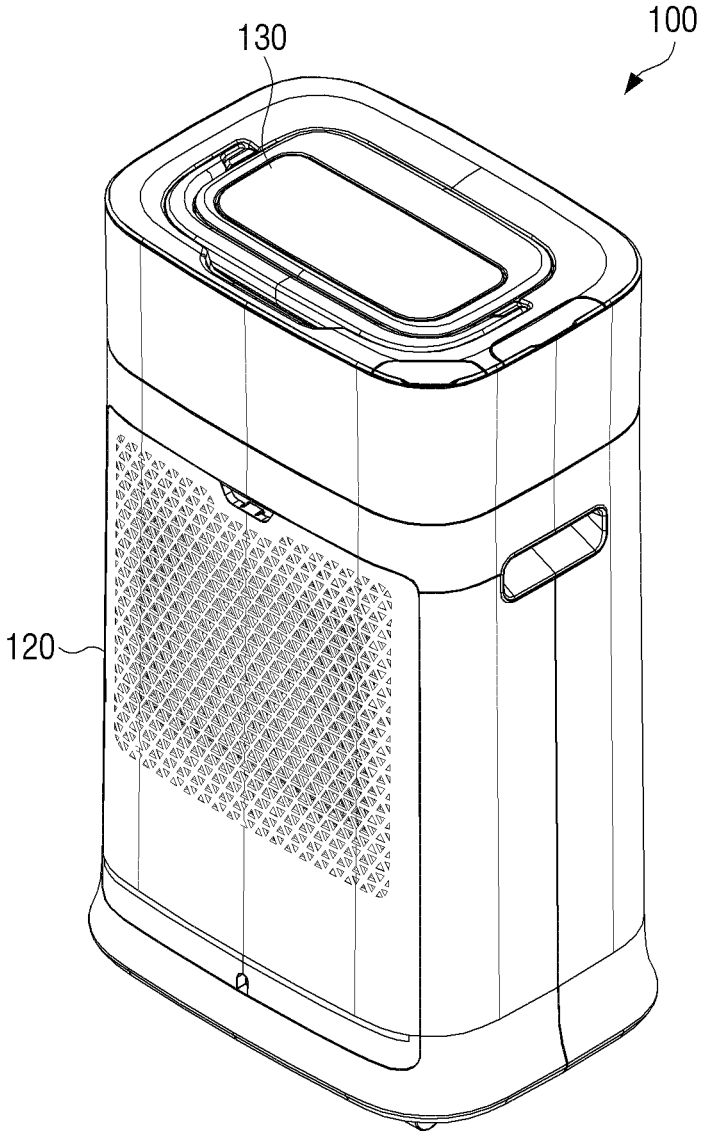
FIG. 2 is a perspective view illustrating a rear side of the dehumidifier of FIG. 1.

FIG. 1 is a perspective view illustrating a front side of a dehumidifier according to an exemplary embodiment of the present invention. FIG. 2 is a perspective view illustrating a rear side of the dehumidifier of FIG. 1. Referring to FIGS. 1 and 2, a dehumidifier 100 may include a body 110 forming an external appearance. A bucket assembly (not shown) may be installed at a front side of the dehumidifier 100, and a cover 120 having a plurality of holes in fluid communication with an intake opening (not shown) may be installed at a rear side of the dehumidifier 100. Position relationship between the bucket assembly and the cover 120 is not limited thereto.

A filter (not shown) may be fixedly installed inside the cover 120 and operates to filter foreign substances in air that flows in through the cover. The filter may include at least one selected from a free filter that removes a relatively large amount of dust included in air, a deodorization filter that removes smells, a dust collector filter that collects dust through electrical actions, and a HEPA filter that removes fine dust. The cover 120 may be detachably combined with the body so as to easily replace the filter.

A display (not shown) that displays an operation state of the dehumidifier 100 may be provided on the front side of the body 110. Also, operation buttons (not shown) that control an operation of the dehumidifier 100 may be provided on a side of the display. Positions of the display and the operation buttons are not limited to the front side of the body.

A discharge opening 140 (see FIG. 3) may be formed in an upper side of the body and may be opened and closed by a discharge louver 130. If the dehumidifier 100 operates by a manipulation of the operation button, the discharge louver 130 moves upwards so as to open the discharge opening 140. If the operation of the dehumidifier 100 stops, the discharge louver 130 moves downwards so as to cover the discharge opening 140. If the discharge louver 130 covers the discharge opening 140, pollution and malfunction of the dehumidifier 100 caused by foreign substances permeating into the body 110 may be prevented.

As will be described in exemplary embodiments hereinafter, the discharge opening 140 is formed in the upper side of the body, and the intake opening is formed in a side of the body, but positions of the discharge opening 140 and the intake opening may be changed.

Although not shown, the body 110 includes a heat exchanger capable of heat exchange with air. The heat exchanger may include a compressor that compresses a refrigerant, a condenser that cools and condenses the refrigerant by air passing through the body, an expansion valve that decompresses and expands the refrigerant, and an evaporator that evaporates the decompressed and expanded refrigerant so as to absorb heat from air that flows into the body. Also, the body 110 further includes a blowing fan 210 (see FIG. 4) that enables air to flow through the body 110.

Therefore, if air of an indoor space is forced to pass through the evaporator of the body, moisture included in the air is condensed on a surface of the evaporator, and thus dehumidifying is achieved. The air which is dehumidified through the evaporator may be re-discharged through the discharge opening 140 (see FIG. 3) so as to lower humidity of the indoor space.

Figure 3:
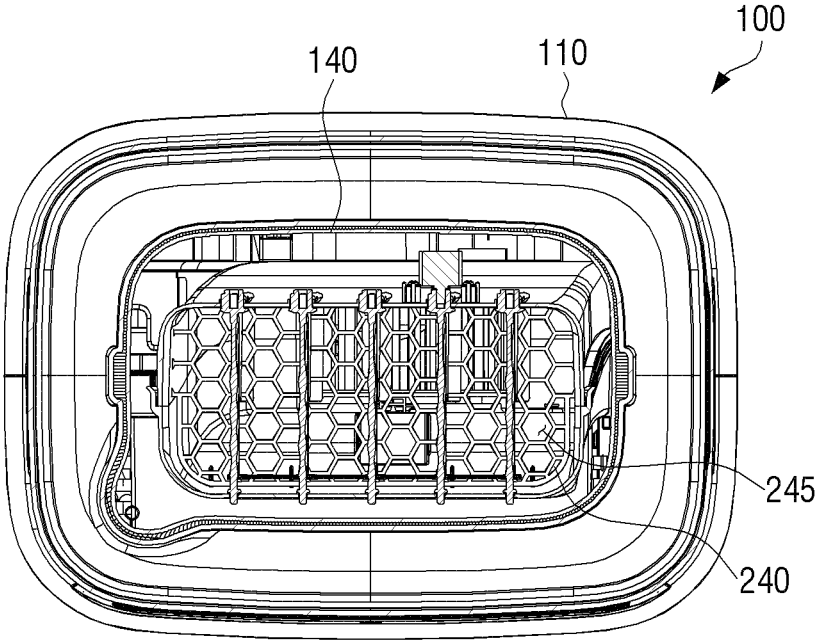
FIG. 3 is a cross-sectional view of the dehumidifier taken along a line of FIG. 1.
Figure 4:
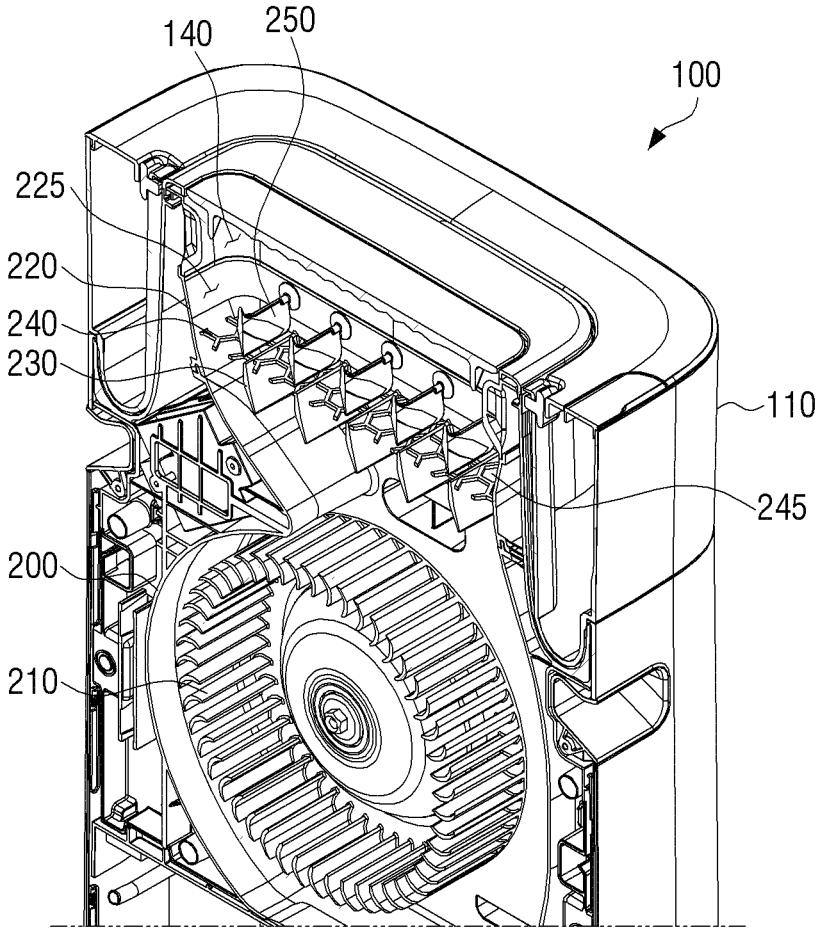
FIG. 4 is a cross-sectional view of the dehumidifier taken along a line IV-IV of FIG. 1.

FIG. 3 is a cross-sectional view of the dehumidifier taken along a line of FIG. 1. FIG. 4 is a cross-sectional view of the dehumidifier taken along a line IV-IV of FIG. 1. Referring to FIGS. 3 and 4, the dehumidifier 100 includes the body 110 that has the intake opening and the discharge opening 140 and forms the external appearance of the dehumidifier 100. The heat exchanger may be installed inside the body 110, and a fan case 200 may be installed in front of the heat exchanger.

The blowing fan 210 may be installed inside the fan case 200, and a duct 220 is provided at an upper part of an inner side of the fan case 200. The blowing fan 210 generates a suction force for drawing air into the body 110 and a blowing force for blowing dehumidified air to the discharge opening 140 through rotation driving. The duct 220 provides a channel which guides air flowing by the blowing fan 210, and a communication opening 225 that is in fluid communication with the discharge opening 140 is formed in an upper part of the duct 220.

The duct 220 has a shape of which a cross-sectional area increases upwards so as to easily discharge dehumidified air to the communication opening 225. Fixed blades 230 and a dispersion plate 240 are installed inside the duct 220. The fixed blades 230 are respectively arranged across a width direction of the communication opening 225 and arranged at preset distances along a longitudinal direction of the communication opening 225.

The dispersion plate 240 is installed in the upper side of the fixed blades 230. The dispersion plate 240 is arranged along a horizontal direction and has a plurality of dispersion holes 245. Air that is split through the fixed blades 230 may be equally dispersed and discharged through the dispersion holes 245. The dispersion holes 245 may have hexagonal shapes, and the dispersion plate 240 may have a honeycomb structure.

The dispersion holes 245 may be replaced with several kinds of shapes including a circular shape, an elliptical shape, a triangular shape, and a square shape. However, dispersion holes 245 provided as hexagonal shapes may provide an increased strength to the dispersion plate 40. Also, since a size of an internal angle of a hexagon has 120 degrees, the hexagons may maximize a ventilation effect in comparison with triangles or squares having the same size which can be tessellated.

Also, the fixed blades 230 and the dispersion plate 240 may be provided as an all-in-one structure along with the fan case 200. If the fixed blades 230 and the dispersion plate 240 are provided as the all-in-one structure along with the fan case 200, an additional fastening work is not necessary, thereby improving product productivity and efficiency.

Rotating blades 250 are installed above the dispersion plate 240. The rotating blades 250 are arranged across the width direction of the communication opening 225. The rotating blades 250 may rotate along the longitudinal direction of the communication opening 225, and a discharge direction of air that passes through the dispersion plate 240 may be changed by rotating of the rotating blades 250.

Hereinafter, detailed structures and operation effects of the fixed blades 230, the dispersion plate 240, and the rotating blades 250 will be described.

Figure 5:
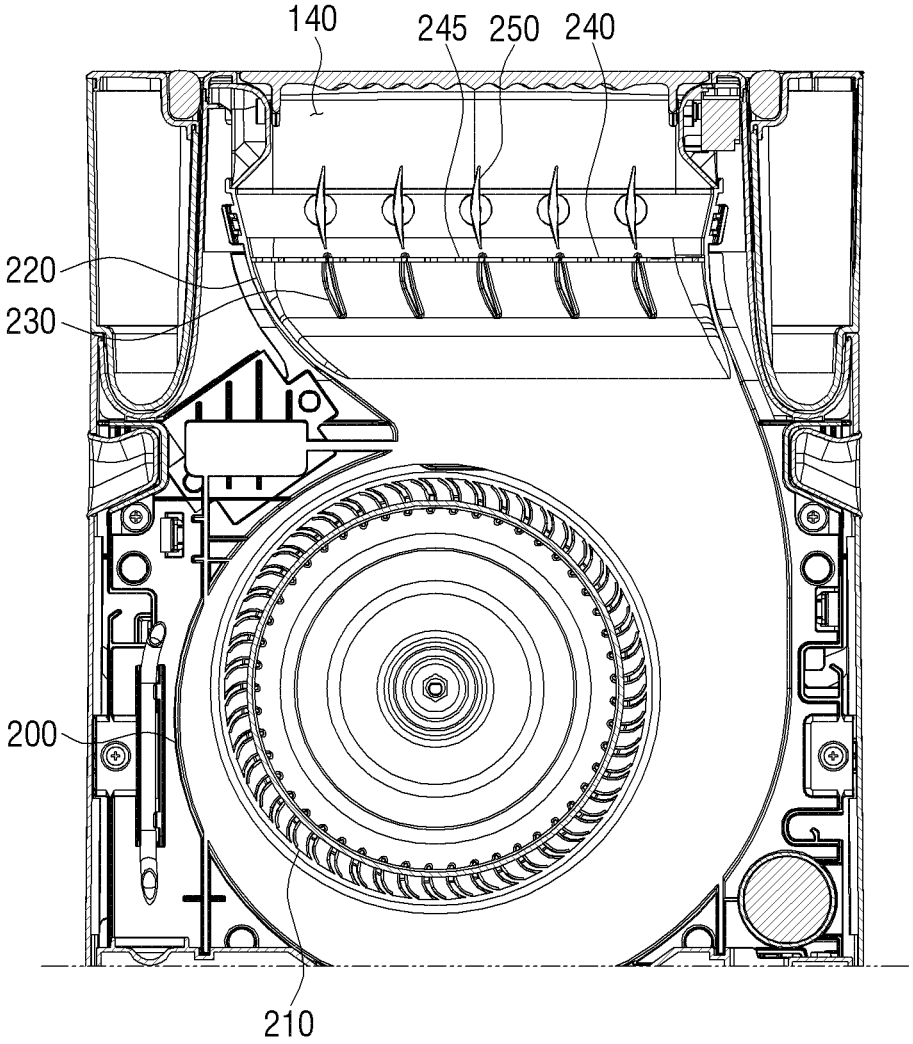
FIG. 5 is a front view of the dehumidifier of FIG. 4.
Figure 6:
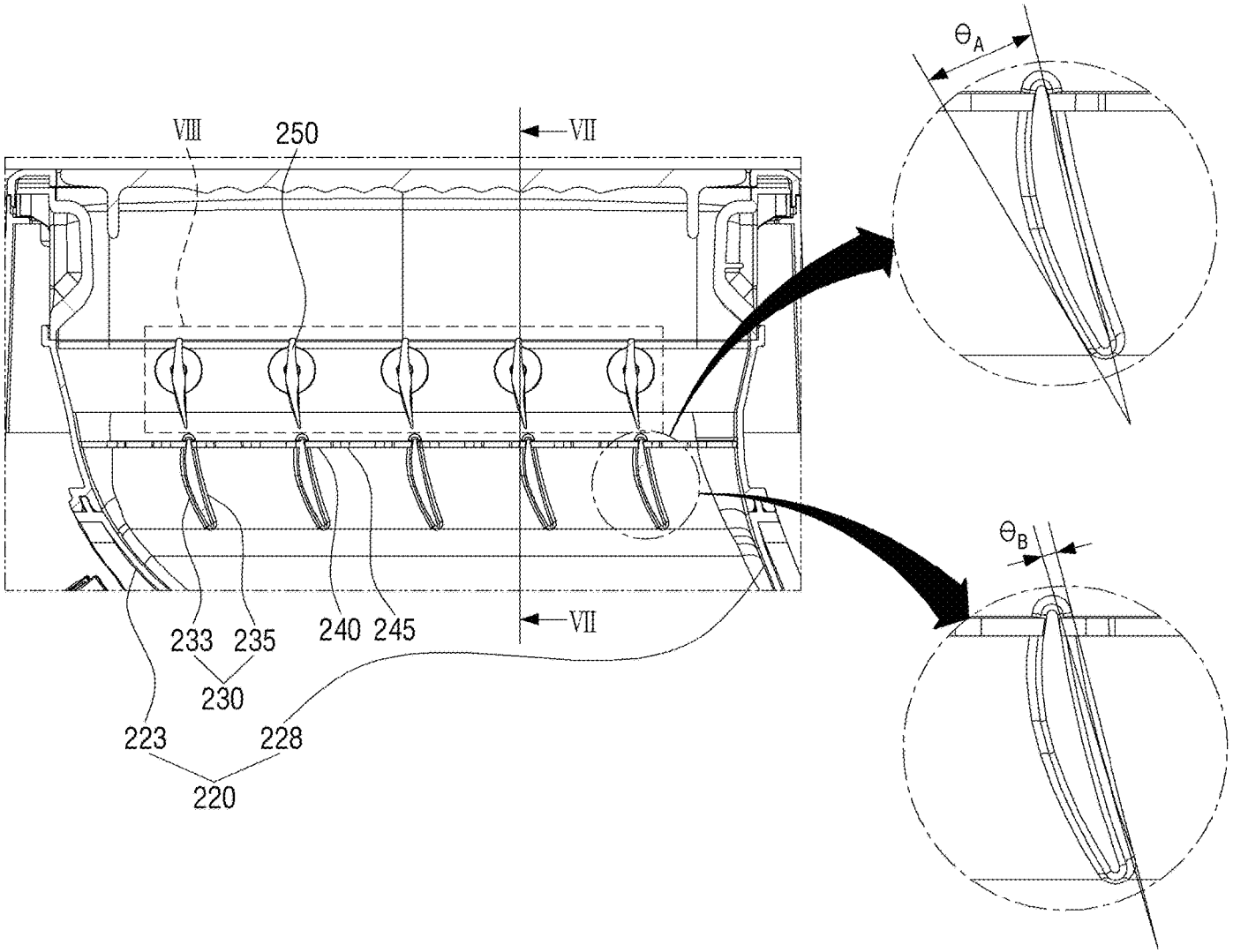
FIG. 6 is an enlarged view of a part VI of FIG. 5.

FIG. 5 is a front view of the dehumidifier of FIG. 4. FIG. 6 is an enlarged view of a part VI of FIG. 5. Referring to FIGS. 5 and 6, the fixed blades 230 have preset heights along upward and downward direction and are arranged to be parallel with one another. The fixed blades 230 may have the preset heights along the upward and downward direction so as to secure a flowing time of air that flows to the duct 220.

As aforementioned, the fan case 200 includes the duct 220 for providing the channel through which air flows. The duct 220 may have the shape of which the cross-sectional area increases upwards so as to enable dehumidified air to easily flow toward the communication opening 225.

For example, the duct 220 may include a first slope part 223 that has a shape sloping upwards toward the communication opening 225 and a second slope part 228 that is arranged to be opposite to the first slope part 223. The second slope part 228 may have a gentle slope in comparison with the first slope part 223.

In this case, the fixed blades 230 may be arranged so that upper ends and lower ends of the fixed blades 230 are off-center according to the shape of the duct 220. Also, the fixed blades 230 may respectively have front fixed sides 233 that are arranged to face the first slope part 224 and rear fixed sides 235 that are arranged to face the second slope part 228. The front fixed sides 233 have first curvatures $\theta_A$ that are convex toward the first slope part 223, and the rear fixed sides 235 have second curvatures $\theta_B$ that are concave toward the second slope part 228.

The first curvatures may be larger than the second curvatures ($\theta_A > \theta_B$), and the first curvatures of the front fixed sides 233 and the second curvatures of the rear fixed sides 235 may be changed so as to correspond to the shape of the duct 220. As the fixed blades 230 have curvatures having preset arc shapes as described above, a discharge path of air may be split to a plurality of discharge paths without lowering a flow velocity of air that flows by the blowing fan 210.

Air that is blown through rotating of the blowing fan 210 flows as an air current, which is off-center toward a side of the communication opening 225, toward the fixed blades 230. As the fixed blades 230 have the preset heights along the upward and downward direction and are arranged at the preset distances along the longitudinal direction of the communication opening 225, the off-center air current may pass through the fixed blades 230 so as to be changed to a linear air current.

The air that is changed to the linear air current by the fixed blades 230 passes through the dispersion holes 245 of the dispersion plate 240 that is connected to the upper ends of the fixed blades 230. Therefore, the discharged air may be equally dispersed when being changed to the linear air current, and then discharged to an outside.

Figure 7:
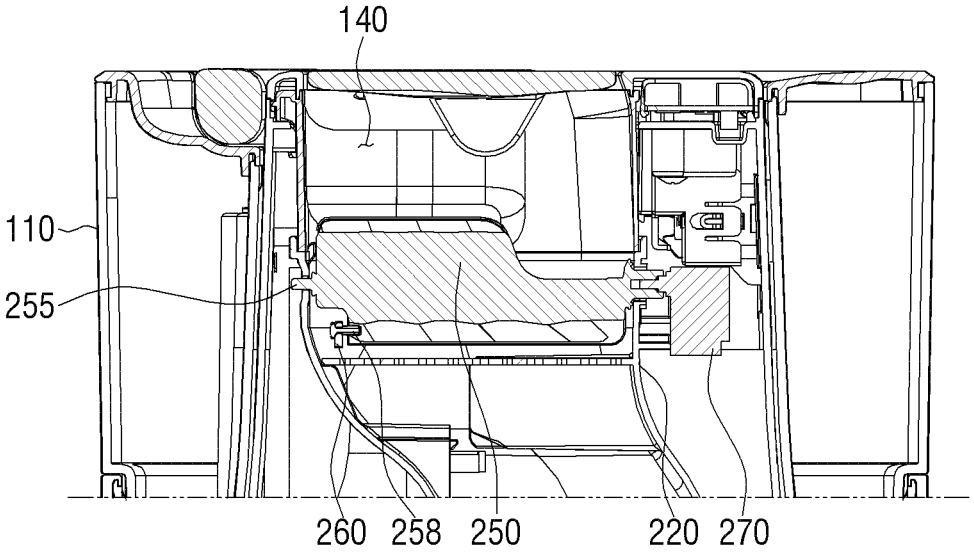
FIG. 7 is a cross-sectional view of the dehumidifier taken along a line VII-VII of FIG. 6.
Figure 8:
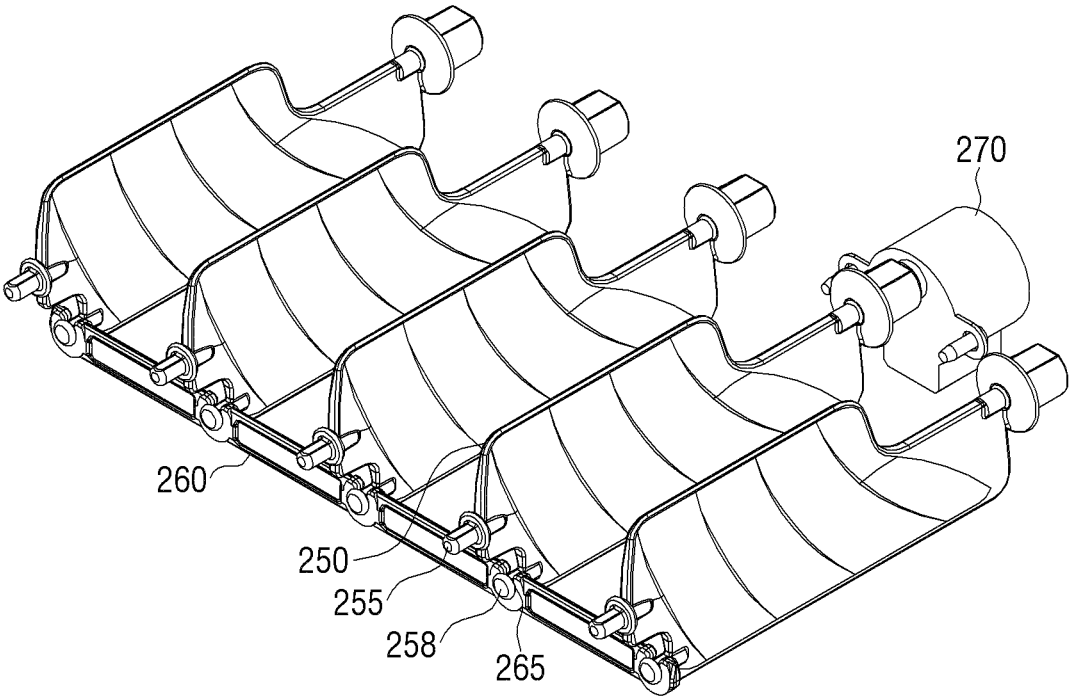
FIG. 8 is an enlarged view of a part VIII of FIG. 6.

FIG. 7 is a cross-sectional view of the dehumidifier taken along a line VII-VII of FIG. 6. FIG. 8 is an enlarged view of a part VIII of FIG. 6. Referring to FIGS. 7 and 8, the rotating blades 250 are installed above the dispersion plate 240. The rotating blades 250 may rotate along the longitudinal direction of the communication opening 225. Therefore, a discharge direction of air that passes through the fixed blades 230 and the dispersion plate 240 may be changed by rotation angles of the rotating blades 250.

For example, rotation axes 255 are connected to the rotating blades 250 so as to rotate along with the rotating blades 250. The rotation axes 255 are arranged across the width direction of the communication opening 225 so as to correspond to longitudinal directions of the rotating blades 250. A plurality of rotating blades 250 may be provided and may be arranged at preset distances from one another along the longitudinal direction of the communication opening 225.

The plurality of rotating blades 250 may be connected to a link member 260 so as to rotate in the same direction.

In detail, the rotating blades 250 may respectively have projections 258 that are formed under the rotating axes 255. The projections 258 are arranged side by side with the rotation axes 255. Sides of the rotating blades 250 may be rotatably supported by the duct 220, and other sides of the rotating blades 250 may be connected to the link member 260.

The link member 260 may be arranged so as to be parallel with the longitudinal direction of the communication opening 225. Also, the link member 260 has fixing holes 265 that are perforated along a thickness direction, and the projections 258 are respectively inserted into the fixing holes 265 corresponding thereto. Therefore, the rotating blades 250 may be connected to one another so as to operate along with one another through the link member 260.

A driving member 270 may be installed inside the body 110 and may be arranged outside the duct 220. The driving member 270 is connected to at least one rotation axis 255 so as to rotate the rotation axis 255. Therefore, if the driving member 270 provides one rotation axis 255 with a rotational force, the rotating blades 250 that are connected to the link member 260 rotate in the same direction.

The driving member 270 may be a step motor having a precision for accurately adjusting the number of rotations of a motor. However, the driving member 270 is not limited to the step motor and may be replaced with a linear motor, a spindle motor, a servo motor, or the like capable of proving the rotating blades 250 with a rotational force.

The rotating blades 250 may rotate in one direction by a driving force of the driving member 270 to position in a first position where the upper ends of the rotating blades 250 are off-center to one sides of the lower ends thereof, and may rotate in an opposite direction thereby switching to a second position where the upper ends of the rotating blades 250 are off-center to the other sides of the lower ends thereof.

The rotating blades 250 have been described above as having the number corresponding to the fixed blades 230 but may have the number equal to or smaller than the number of fixed blades 230. For example, ten fixed blades 230 may be arranged at preset distances from one another, and five rotating blades 250 may be arranged at distances two times wider than the distances of the fixed blades 230.

The numbers of fixed blades 230 and rotating blades 250 are not limited thereto, but the rotation axes 255 of the rotating blades 250 may be positioned in the vertical direction with respect to the fixed blades 230 so as to minimally interfere a flowing path of air, thereby maximizing a blowing effect.

Figure 9:
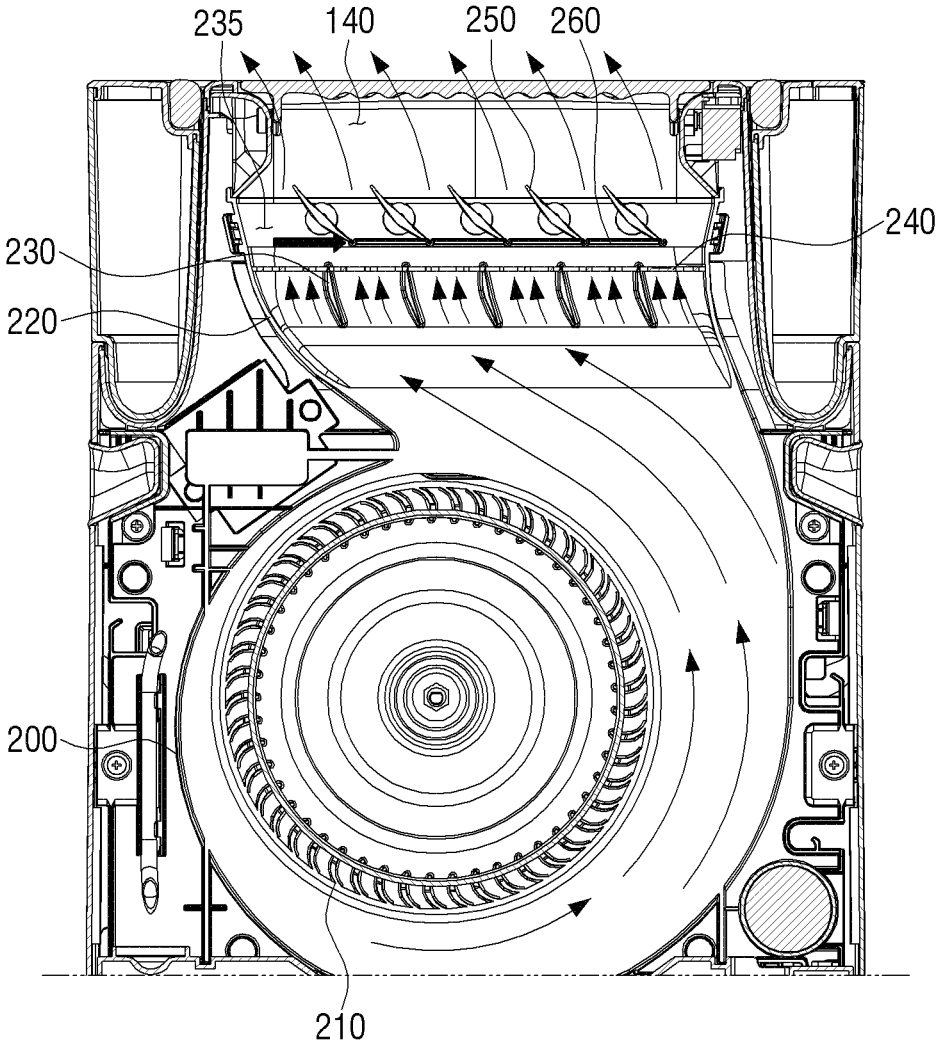
FIGS. 9 and 10 are views illustrating a process of operating a dehumidifier according to an exemplary embodiment of the present invention.
Figure 10:
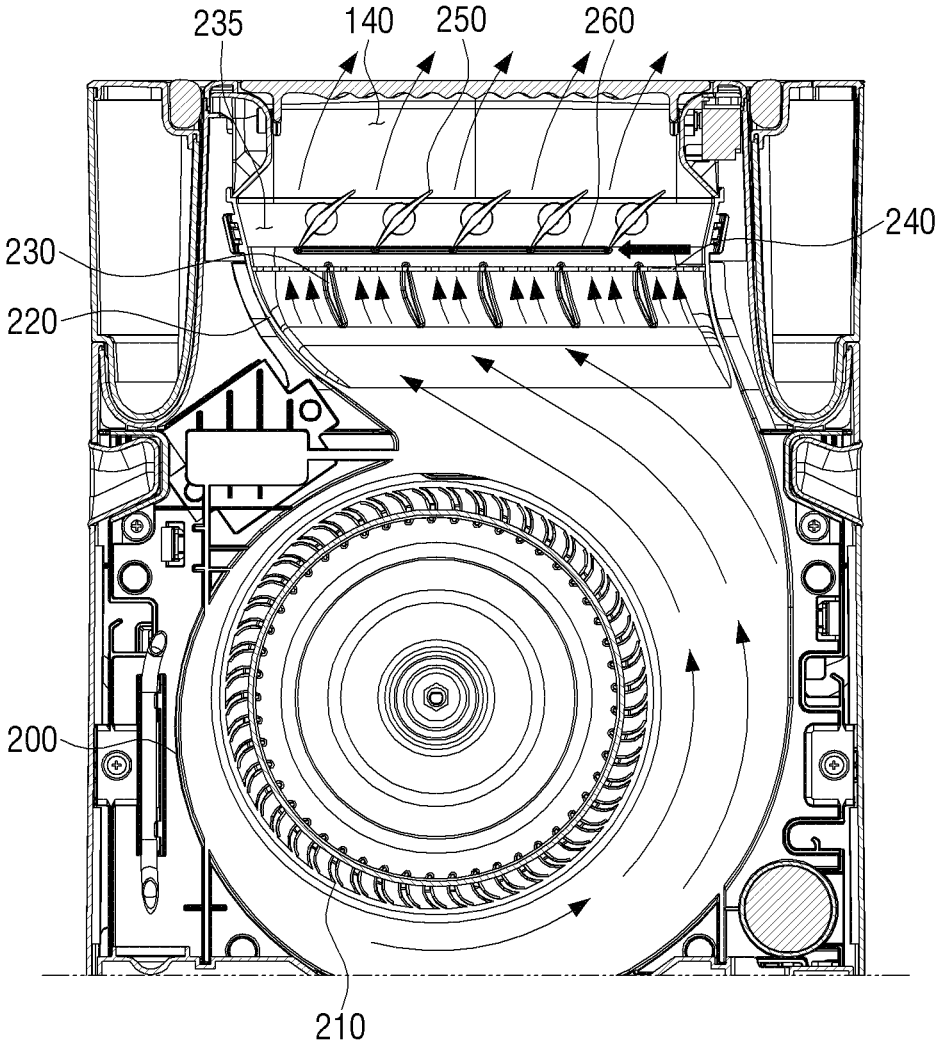

FIGS. 9 and 10 are views illustrating a process of operating the dehumidifier according to an exemplary embodiment of the present invention. As described with reference to FIGS. 1 and 2, air of an indoor space is purified through a filter and then flows into the body through the intake opening. The air that flows in goes through a heat exchange process with a refrigerant that is circulated through the heat exchanger. Moisture included in the air is formed in a condensate water on the heat exchanger through the heat exchange process, and the condensate water is housed in a bucket of the bucket assembly.

Referring to FIGS. 9 and 10, air from which moisture is removed by the heat exchanger is discharged to the discharge opening 140 through the duct 220. The dehumidified air flows to the upper side of the duct 220 by rotating of the blowing fan 210. Air that is discharged through centrifugal force of the blowing fan 210 flows in a state biased toward the same direction as a rotation direction of the blowing fan 210.

Air that flows into the duct 220 is equally split to a plurality of discharge paths by the fixed blades 230 that are installed at the duct 220. In this case, the fixed blades 230 have preset curvatures so as to correspond to the shape of the duct 220. Therefore, air that flows by the blowing fan 210 is split to the plurality of discharge paths and a decrease in a flow velocity is minimized.

Also, the fixed blades 230 may have the preset heights along the upward and downward direction and may be arranged at the preset distances along the longitudinal direction of the communication opening 225 so as to change an air current or a turbulent flow, which is off-center toward a side of the duct 220, to a linear air current.

The air that is changed to the linear air current through the fixed blades 230 passes through the dispersion holes 245 of the dispersion plate 240 that is connected to the upper ends of the fixed blades 230. Therefore, discharged air is equally dispersed in a state of being changed to the linear air current. A discharge direction of the air that is equally dispersed is determined according to rotation positions of the rotating blades 250.

Due to this, a user may discharge dehumidified air in a desired direction. For example, the user may reversely set the discharge direction of the dehumidified air and things to be dried (e.g., laundry and the like) which need dehumidifying. Also, when the dehumidifier 100 is used for a general purpose, the driving member 270 may be set to continuously rotate the rotating blades 250 to left and right sides so that the dehumidified air is equally discharged to the indoor space.

Therefore, the dehumidifier 100 according to an exemplary embodiment of the present invention may effectively change a discharge direction of dehumidified air according to a desire of the user. Also, a linear air current and equally dispersed air may be discharged to efficiently perform dehumidifying so as to provide a pleasant indoor space. In addition, unnecessary power waste may be minimized through an efficient indoor space.

In an exemplary embodiment of the present invention described above, a dehumidifier having a structure for controlling an air current by using fixed blades, a dispersion plate, and rotating blades has been described as an example. However, the present invention may be applied to and used in various types of home appliances including an air conditioner, a hot air heater, and the like that generate an air current that is off-center to a side through a blowing fan.

Various exemplary embodiments of the present invention have been individually described but are not necessarily separately embodied, and structures and operations of the respective exemplary embodiments may be combined and embodied with at least one other exemplary embodiments.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

The invention claimed is:

1. A dehumidifier comprising:

a body having an intake opening and a discharge opening;

a blowing fan arranged inside the body and configured to draw air into the body through the intake opening and to discharge the air to an outside through the discharge opening;

a fan case arranged inside the body and provided with a duct forming a channel through which the air drawn by the blowing fan flows to the discharge opening; and a plurality of fixed blades fixedly installed inside the duct and configured to split the air, which flows through the channel, to a plurality of discharge paths, each of the fixed blades comprising:

a front fixed side having a curved shape corresponding to a front curvature angle, and a rear fixed side having a curved shape corresponding to a rear curvature angle, the rear curvature angle being less than the front curvature angle, wherein the duct comprises a first slope part having a shape sloping upwards to the discharge opening, the first slope part having a first slope angle from an upward direction, and a second slope part that is arranged opposite to the first slope part, the second slope part having a second slope angle from the upward direction, the second slope angle that is more acute than the first slope angle, and wherein the front fixed side of each of the fixed blades is arranged to face the first slope part and is convex toward the first slope part, and the rear fixed side of each of the fixed blades is arranged to face the second slope part and is concave toward the second slope part.

2. The dehumidifier of claim 1, wherein the fixed blades are arranged across a width direction of the discharge opening.

3. The dehumidifier of claim 2, wherein the fixed blades have preset heights toward the discharge opening and are arranged to be parallel with one another.

4. The dehumidifier of claim 2, wherein the discharge opening is provided in an upper surface of the body above the plurality of fixed blades, and upper ends and lower ends of the fixed blades are arranged to be off-center to one another.

5. The dehumidifier of claim 4, wherein:

the duct has a shape of which a cross-sectional area increases upwards.

6. The dehumidifier of claim 1, further comprising:

a dispersion plate that is arranged on sides of the fixed blades inside the duct and has a plurality of dispersion holes through which air flowing through the fixed blades is dispersed.

7. The dehumidifier of claim 6, wherein the dispersion holes are hexagonal shapes, and the dispersion plate is formed in a honeycomb structure.

8. The dehumidifier of claim 1, further comprising:

a rotating blade that is arranged to a side of each of the fixed blades and configured to change a discharge direction of air that flows through the fixed blades.

9. The dehumidifier of claim 8, wherein the discharge opening is formed in an upper surface of the body above the plurality of fixed blades, and the rotating blade is arranged across a width direction of the discharge opening.

10. The dehumidifier of claim 9, wherein the rotating blade includes a plurality of rotating blades, and the rotating blades have preset heights along upward and downward directions and are arranged to be parallel with one another.

11. The dehumidifier of claim 9, further comprising a communication opening formed in an upper surface of the duct below the discharge opening and fluidly connected to the discharge opening, wherein the fixed blades are arranged at preset distances along a longitudinal direction of the communication opening and have preset heights along an upward and downward direction, and wherein a number of rotating blades is equal to or smaller than a number of the fixed blades.

12. The dehumidifier of claim 10, further comprising:

a plurality of rotation axes that are respectively axially combined with the rotating blades and are rotatably supported by the duct;

a motor that is connected to at least one of the rotation axes and configured to rotate the at least one of the rotation axes; and a link member that is arranged under the rotation axes and connected to the rotating blades.

13. The dehumidifier of claim 12, wherein the rotating blades are arranged under the rotation axes and have projections projecting from the rotating blades, and wherein the link member is arranged perpendicular to the rotating blades and has fixing holes into which the projections are inserted and rotatably supporting the projections.

14. The dehumidifier of claim 12, wherein the rotating blades rotate in one direction by a driving force of the motor to position in a first position where upper ends of the rotating blades are off-center to sides of lower ends of the rotating blades, and rotate in an opposite direction to switch to a second position where the upper ends of the rotating blades are off-center to other sides of the lower ends of the rotating blades.

15. A dehumidifier comprising:

a body having an intake opening and a discharge opening;

a blowing fan arranged inside the body and configured to draw air into the body through the intake opening and to discharge the air to an outside through the discharge opening;

a fan case arranged inside the body and provided with a duct forming a channel through which the air drawn by the blowing fan flows to the discharge opening;

fixed blades fixedly installed inside the duct and configured to split the air, which flows through the channel, to a plurality of discharge paths, each of the fixed blades comprising:

a front fixed side having a curved shape corresponding to a front curvature angle, and a rear fixed side having a curved shape corresponding to a rear curvature angle, the rear curvature angle being less than the front curvature angle;

rotating blades arranged in the duct above the fixed blades and configured to change a discharge direction of air that flows through the fixed blades; and a dispersion plate arranged between the fixed blades and the rotating blades and having a plurality of dispersion holes through which the air split by the fixed blades is dispersed, wherein the duct comprises a first slope part having a shape sloping upwards to the discharge opening, the first slope part having a first slope angle from an upward direction, and a second slope part that is arranged opposite to the first slope part, the second slope part having a second slope angle from the upward direction, the second slope angle that is more acute than the first slope angle, and wherein the front fixed side of each of the fixed blades is arranged to face the first slope part and is convex toward the first slope part, and the rear fixed side of each of the fixed blades is arranged to face the second slope part and is concave toward the second slope part.

* * * * *